US007037164B2

(12) United States Patent
Silverglate

(10) Patent No.: US 7,037,164 B2
(45) Date of Patent: May 2, 2006

(54) FLYING TOY APPARATUS

(75) Inventor: David E. Silverglate, Santa Cruz, CA (US)

(73) Assignee: Rhino Toys, Inc., Santa Cruz, CA (US)

( * ) Notice: Subject to any disclaimer, the term of this patent is extended or adjusted under 35 U.S.C. 154(b) by 48 days.

(21) Appl. No.: 10/777,507

(22) Filed: Feb. 11, 2004

(65) Prior Publication Data

US 2004/0224600 A1 Nov. 11, 2004

Related U.S. Application Data

(60) Provisional application No. 60/447,055, filed on Feb. 12, 2003.

(51) Int. Cl.
*A63H 27/14* (2006.01)

(52) U.S. Cl. ..... 446/63; 124/16

(58) Field of Classification Search ..... 446/61–68; 244/16, 153 R, 154, 155 R; 124/16, 17, 124/20.1

See application file for complete search history.

(56) References Cited

U.S. PATENT DOCUMENTS 3,408,767 A * 11/1968 Anderson ..... 446/62
3,559,331 A * 2/1971 Eller ..... 446/34
4,915,664 A * 4/1990 Bakker ..... 446/62
5,240,448 A * 8/1993 Ishikawa ..... 446/64
5,277,169 A * 1/1994 Magnuson ..... 124/20.1
5,423,706 A * 6/1995 Chase ..... 446/62
6,349,902 B1 * 2/2002 Cripe ..... 244/153 R
6,733,356 B1 * 5/2004 Lee ..... 446/63

* cited by examiner

*Primary Examiner*—Kien Nguyen
(74) *Attorney, Agent, or Firm*—Alleman Hall McCoy et al

(57) ABSTRACT

A flying toy apparatus is provided. The flying toy apparatus typically includes a body having an elongate channel formed therein, the channel extending in a longitudinal direction along the body. The flying toy apparatus also typically includes an elastic launch member coupled to the body and configured to be stretched forward in the longitudinal direction by a digit of a user. The channel is typically configured to accommodate passage of the digit therein during launch of the body over the digit. A foam nose member may be coupled to a leading portion of the body to soften impact and/or guide the digit into the channel. A grip may be provided on the body for the user to securely hold the apparatus during launch. Fins may also be provided on the body.

43 Claims, 3 Drawing Sheets

FLYING TOY APPARATUS

CROSS-REFERENCES TO RELATED APPLICATIONS

This application claims priority under 35 U.S.C. § 119 to U.S. Provisional Application Ser. No. 60/447,055, entitled "Flying Toy Apparatus," which was filed on Feb. 12, 2003, the entire disclosure of which is hereby incorporated by reference.

BACKGROUND

Both children and adults alike have enjoyed playing with a variety of hand-launched flying objects over the years. Perhaps the simplest of these objects, rubber bands, provide for a quick launch, but do not glide well and often painfully smack into a finger or thumb during launch. Toy gliders, such as paper airplanes, and their more sturdy balsa wood and plastic cousins, are typically configured to be thrown by a user and gently glide back to the ground.

To take advantage of the quick acceleration provided by rubber bands, certain prior art toy gliders have included a separate catapult launch unit formed by an elastic band secured to a stick. To launch the glider with the catapult launch unit, the user temporarily attaches a free end of the elastic band to a single attachment point on the glider, holds the stick in one hand via an outstretched arm, and pulls the glider back with the other hand until the elastic band is taut. The user next releases the glider, sending it catapulting toward the stick. With luck, the glider will miss the stick and be successfully launched. Unfortunately, luck does not always prevail, and the glider often crashes into the stick or hand of the user. This experience can be frustrating, and tends to decrease the enjoyment of these devices by users.

SUMMARY

A flying toy apparatus is provided. The flying toy apparatus typically includes a body having an elongate channel formed therein, the channel extending in a longitudinal direction along the body. The flying toy apparatus also typically includes an elastic launch member coupled to the body and configured to be stretched forward in the longitudinal direction by a digit of a user. The channel is typically configured to accommodate passage of the digit therein during launch of the body over the digit. A foam nose member may be coupled to a leading portion of the body to soften impact and/or guide the digit into the channel. A grip may be provided on the body for the user to securely hold the apparatus during launch. Fins may be also be provided on the body to improve flight stability.

DETAILED DESCRIPTION OF THE EMBODIMENTS

Figure 1:
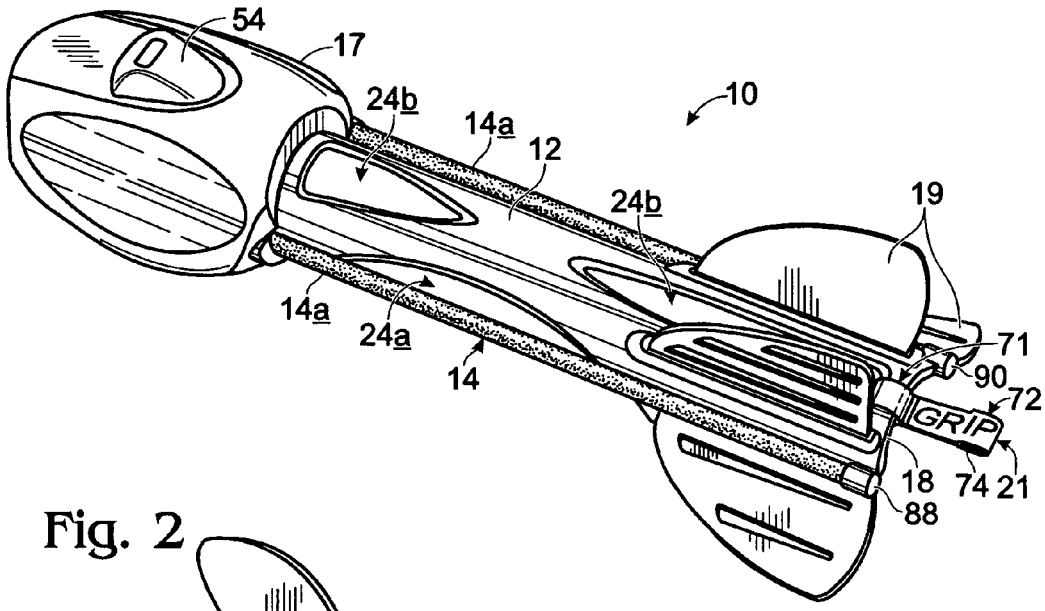
FIG. 1 is a perspective view of a flying toy apparatus according to one embodiment of the present invention, showing a top side of the flying toy apparatus.
Figure 2:
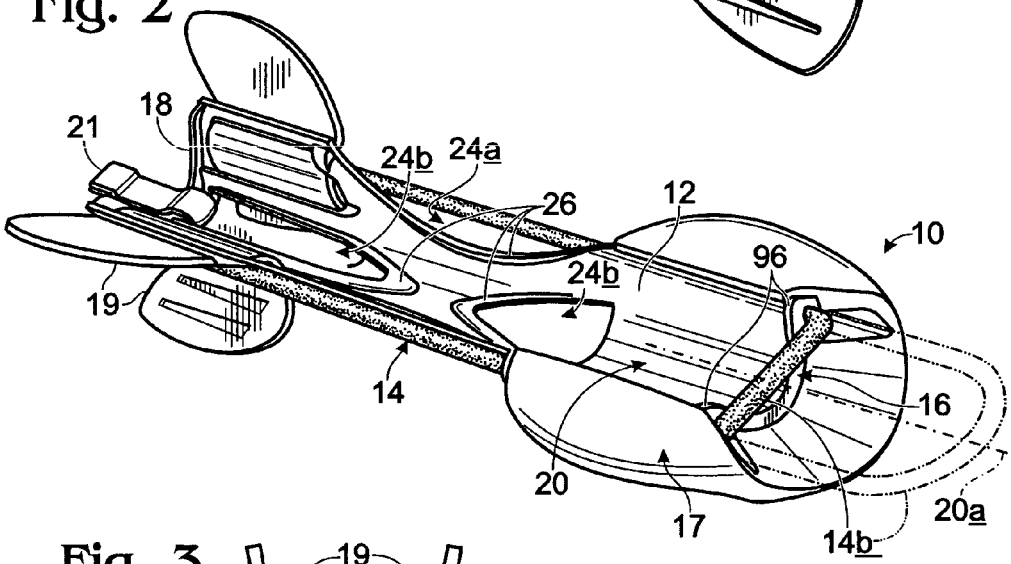
FIG. 2 is a perspective view of the flying toy apparatus of FIG. 1, showing a bottom side of the flying toy apparatus.
Figure 3:
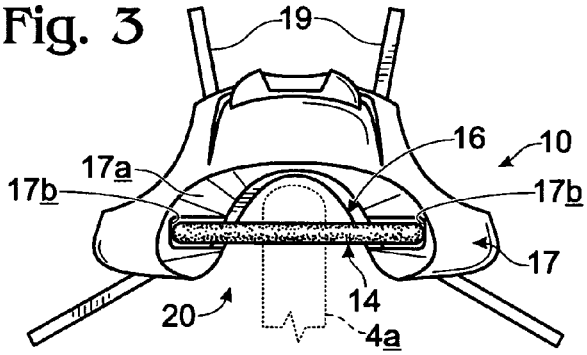
FIG. 3 is a front view of the flying toy apparatus of FIG. 1.
Figure 6:
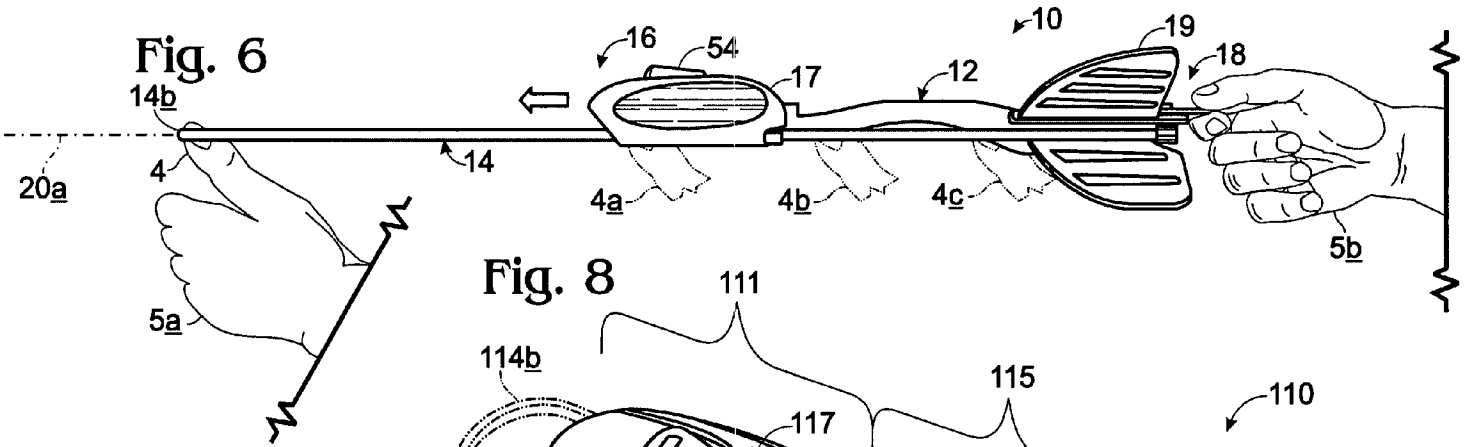
FIG. 6 is a side view of the toy apparatus of FIG. 1, showing the flying toy apparatus held by a user prior to launch.

Referring first to FIGS. 1–3, a flying toy apparatus 10 is shown according to one embodiment of the present invention. Flying toy apparatus 10 typically includes a body 12 with an elastic launch member 14 coupled thereto. The body typically includes a leading portion 16, a trailing portion 18, and an elongate channel 20 formed intermediate the leading and trailing portions, along a longitudinal axis 20*a* of the channel. A nose member 17 may be provided adjacent the leading portion, and fins 19 and a grip 21 may be provided at suitable locations on the body, such as adjacent the trailing portion. As shown in FIG. 6, elastic launch member 14 is typically configured to be stretched forward along longitudinal axis 20*a* by a digit 4 of a first hand 5*a* of a user, while a second hand 5*b* holds grip 21. The user may release the grip to launch the toy apparatus forward, along longitudinal axis 20*a*, over the first hand of the user. Channel 20 is typically formed on the bottom surface of the body, in a downwardly facing orientation, and is generally U-shaped and sized to accommodate passage of digit 4, as the hand of the user passes under the body during launch.

Figure 5:
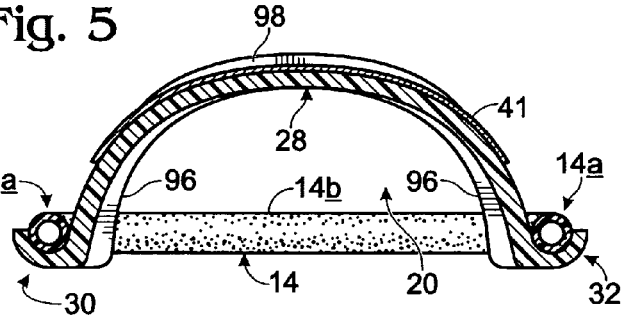
FIG. 5 is a cross-sectional view of the flying toy apparatus of FIG. 1, taken along line 5—5 in FIG. 4.

As shown in FIG. 5, body 12 typically includes an elongate arched portion 28, which defines channel 20. The arched portion, like the rest of body 12, is typically made of a rigid material, such as plastic, suitable to resist the forces of the elastic member and of impact. Typically, the arched portion is formed on a bottom of body 12, and oriented such that the channel opens downwardly. A curved wall of substantially uniform cross-sectional thickness typically forms elongate arched portion 28. Alternatively, it will be appreciated that the arched portion may be formed by a wall or other body of varying thickness, bordered by a curved bottom surface. Typically, the arched portion 28 and channel 20 extend substantially the entire length of a lower surface of the body. Alternatively, it will be appreciated that they may only extend a shorter distance, only partially along the lower surface of the body.

Body 12 also typically includes a plurality of openings 24*a*, 24*b*. Typically the openings are thru-holes that extend entirely through body 12. The position and size of the openings is typically selected to optimize strength, rigidity and weight distribution within toy apparatus 10. The openings also serve to decrease wind resistance, and improve the appearance of toy apparatus 10. Perimeter openings 24*a* are typically positioned on opposite sides of the body, and are formed so as to intersect the edge or perimeter of the body. Internal openings 24*b* are typically positioned on the top or at other locations within body 12. Openings 24*a*, 24*b* are typically provided with reinforced edges 26, to prevent buckling of the body on impact. Reinforced edges 26 are typically of uniform cross-sectional thickness, being formed by an inwardly sloping bevel on the outer surface of the body, and by a corresponding lip on the inner surface, which slopes into channel 20.

Figure 4:
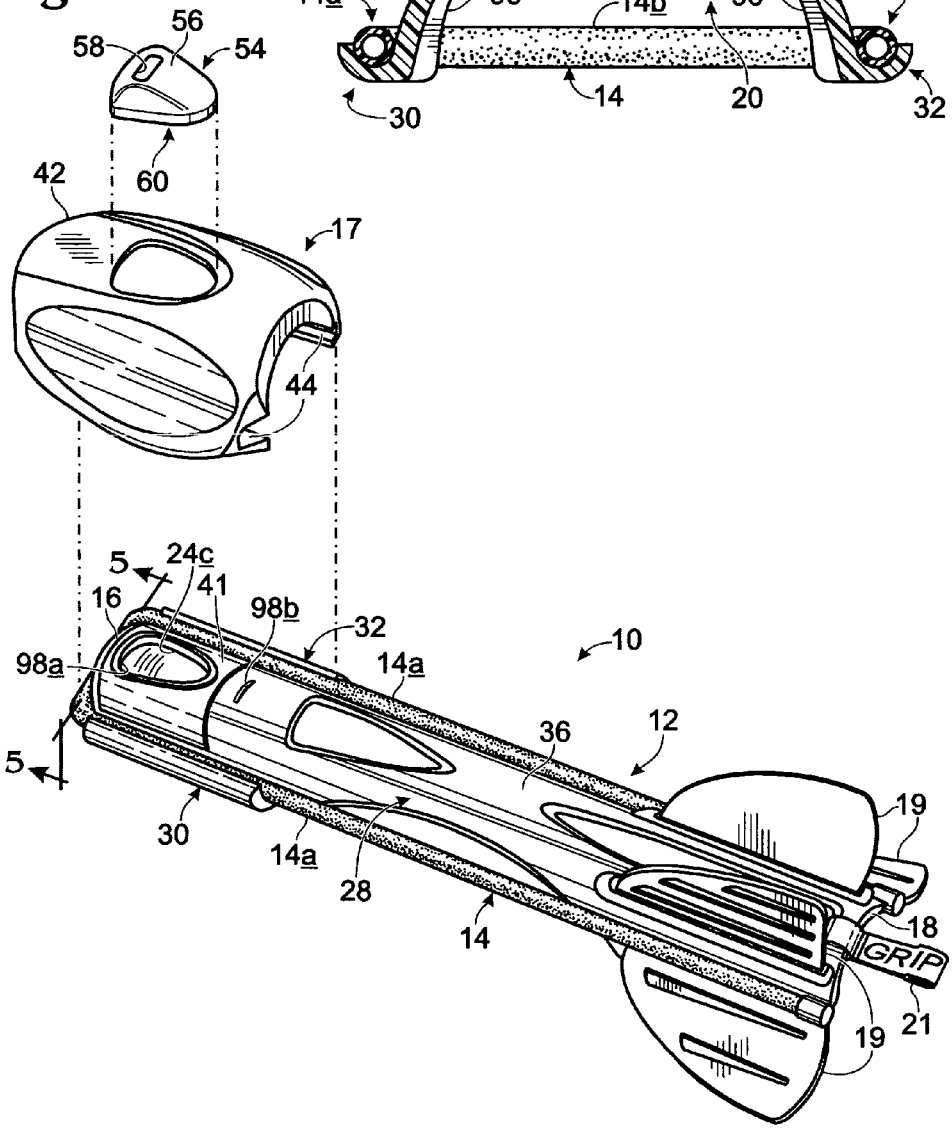
FIG. 4 is an exploded perspective view of the flying toy apparatus of FIG. 1.

As shown in FIG. 4, body 12 also typically includes guides 30, 32 positioned on left and right sides of the body, respectively, adjacent the leading portion 16. Typically, guides 30, 32 are formed of upwardly facing curved portions, which curve in the opposite direction as arched portion 28. Guides 30, 32 are configured to guide elastic member 14 as it is stretched and released, while permitting free longitudinal stretching and sliding of the elongate member therein. Guides 30, 32 are typically configured to extend rearward to a location beyond the rearmost edge of nose member 17 as shown in the figures. While shown as attached to the sides of body 12, it will be appreciated that the guides may attached to the bottom side of body 12, or may be formed in another location. While the guides are typically formed as open notches, it will be appreciated that they may be hollow tubes that completely encircle elastic member 14.

Elastic member 14 typically is formed of a predetermined length of flexible, elastic material, such as latex tubing. It will be appreciated that a variety of other elastic materials may be used. The portions of elastic member 14 positioned within guides 30, 32 and along the sides of the body are referred to as side portions 14*a*. A portion of the elastic member that spans the channel 20, as viewed from the front of the toy apparatus in FIG. 3, is typically referred to as a spanning portion 14*b*. The ends of the elastic member 14 are typically secured on opposite sides of the channel, via anchors 88, 90.

Anchors 88, 90 are typically positioned on the body adjacent the trailing portion 18 such that the elastic member travels substantially the entire length of the body. It will be appreciated that the longer the elastic member, the greater its ability to store energy for launch. Typically, one anchor is provided on each side of channel 20. The anchors 88, 90 and guides 30, 32 are typically mounted lower than an apex of arched portion 28 of the channel, and above a bottom opening of the channel. The anchors 88, 90 and guides 30, 32 are typically positioned at substantially the same height relative to channel 20, such that the side portions 14*a* of elastic member 14 are substantially parallel with channel 20 when at rest. The height of anchors 88, 90 and guides 30, 32 are typically identical to the height of longitudinal axis 20*a*, as viewed from a side of the toy apparatus.

Nose member 17 is typically mounted to the body adjacent a leading portion 16 of the body, and adjacent a front opening of channel 20. The nose member is typically made of resilient, impact absorbing material, such as foam. Typically, a closed-cell or self-skinning foam is used, although a variety of other foams, as well as non-foam materials, may be used. Nose member 17 is configured to have a wide, rounded front face 42, which is soft and resilient to the touch. These features enable the nose member to absorb and distribute over a large area impact forces caused by the landing or collision of apparatus 10.

As shown in FIG. 3, the nose member may include a guide surface 17*a* extending forward of the front opening of the channel. The guide surface is typically configured to guide the passing digit of a user into the channel as the digit approaches the body during launch. The guide surface is generally funnel-shaped, having a forward opening that is somewhat wider than the front opening of the channel. The guide surface tapers from the wide forward opening, to the narrower opening into channel 16.

As shown in FIG. 4, nose member 17 may further include mounting sleeves 44. Sleeves 44 are configured to mount to the first and second lateral edges 30, 32, during assembly of the apparatus. Nose member 17 and body 12 are typically assembled by aligning the front edges of the guides 30, 32 with the rear openings of the sleeves 44. Nose member 17 is subsequently pulled over body 12, causing the guides to slide into the sleeves. Sleeves 44 of nose member 17 may act to retain side portions 14*a* of elastic member 14 in their respective guides 30, 32. Alternatively, it will be appreciated that nose member 17 may not include sleeves 44. Rather, nose member 17 may rest on a top surface 36 of arched portion 28 and be secured by an adhesive or other means. It will be appreciated that nose member 17 and body 12 may include mating grooves and flanges, such as 98, 98*a*, and 98*b*, which assist in properly aligning and assembling flying toy apparatus 10. Adhesives may also be used to join nose member 17 to body 12.

Holes 17*b* are typically provided in guide surface 17*a*, on respective sides of channel 20, as viewed from the front of the apparatus. Elastic member 14 is configured to extend through each of the holes into guides 30, 32. Spanning portion 14*b* is configured to span the distance between the holes when the elastic member is at rest in a retracted state. The longitudinal axis 20*a* is typically centered at the midpoint of spanning portion 14*b*. As shown in FIG. 2, spanning portion 14*b* is configured to rest against a resting flange 96 on the leading portion of body 12, when in the retracted state. As shown at digit position 4*a* in FIGS. 3 and 6, a user's digit 4 may be positioned within the channel, behind the spanning portion, in the retracted state. The inside surface of the channel is configured to accommodate the digit in position 4*a*. From this position, the user may stretch the elastic member forward to an extended configuration parallel to the longitudinal axis 20*a*, shown in dashed lines in FIG. 2 and in FIG. 6, to begin the launch process.

Nose member 17 may also include a whistle 54, as shown in FIG. 4. Whistle 54 is typically positioned adjacent a mounting structure 24*c* on a top surface 36 of the arched portion 28, adjacent leading portion 16. The mounting structure typically includes a lip surrounded by a well. Alternatively, whistle 54 may be disposed on the upper surface of nose member 17, or at another suitable location on apparatus 10. Typically whistle 54 is positioned at a highest point of nose member 17, as viewed from the front, for optimal air flow past the whistle. Whistle 54 may extend downward through nose member 17 to mount to arched portion 28 of body 12, surrounding mounting structure 24*c*. Whistle 54 typically includes a whistle body 56, a whistle slot 58, and a whistle cavity 60 formed by whistle body 56 and the well of the mounting structure on the top surface 36 of arched portion 28, when the whistle is installed. The mounting structure 24*c* and whistle body 56 are typically glued together to adequately seal acoustic whistle cavity 60. The location of the whistle on the apparatus, as well as the shape of the whistle body and cavity may be varied to adjust the sound of the whistle during flight.

To improve flight performance, the body may include a weight 41 coupled thereto. The weight is typically mounted adjacent leading portion 16 of the body, but alternatively may be positioned at another location on the body. The weight is typically sized such that after installation the center of gravity of the apparatus is located approximately one third of the distance from the leading portion to the tailing portion such that the center of gravity is well forward of the center-of-effort (center-of-pressure), as discussed in detail with references to FIG. 8, below. Of course, the center of gravity may be positioned in other positions, in order to achieve desired flight characteristics.

Flying toy apparatus 10 may further include a plurality of flexible fins 19 disposed adjacent the trailing portion 18 of the body 12. In the depicted embodiment, four fins are provided that are made of two pieces of foam that lock into the body 12 without the need for adhesive, forming the horizontal and vertical stabilizers of the flying toy apparatus.

Typically, the fins are formed of soft and/or flexible materials, such as foam or plastic. The fins may be manufactured of a material that temporarily holds a bent shape, such that the fins can be temporarily bent by the user to change the flight pattern of flying toy apparatus 10. For example, if all of the fins 19 are bent in a similar manner in the same direction, flying toy apparatus 10 may spin in flight.

One or more of the plurality of fins 19 may further include a plurality of elongate grooves 62 extending substantially parallel to elongate passage 20, for styling and/or functionality. In addition to giving the toy apparatus a more streamlined appearance, elongate grooves 62 further stabilize the fins 19 even after storage or rough play by preferentially causing the fins to bend along the longitudinal axis such that the fins still provide for flight stability.

Figure 7:
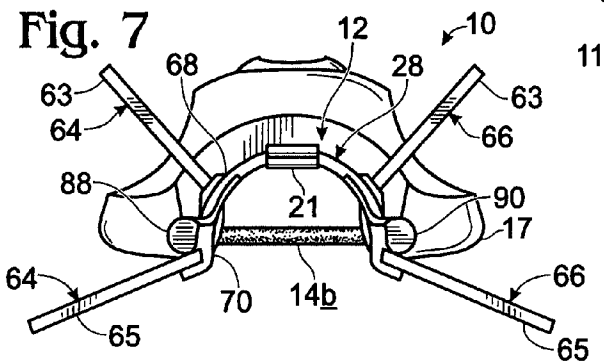
FIG. 7 is a rear view of the flying toy apparatus of FIG. 1.

Fins 19 are typically provided in pairs 64, 66, formed in respective unitary structures. As shown in FIG. 7, first pair of fins 64 is typically a single element that begins as a top left fin 63 above the top surface 36 of body 12, and passes through a slot 68 formed on an upper left rear portion of body 12, before turning sharply to pass back through a second slot 70 formed on a lower left rear portion of body 12, and extending to form a bottom left fin 65 of the pair 64. It will be appreciated that second pair of fins 66, including a top right fin and bottom right fin, is formed of a similar structure on the right side of toy apparatus 10. Slots 68, 70 are typically sized and oriented to cause a sharp bend in the fins, thereby securing fins in place. Similar slots are provided in corresponding locations on the right side of the structure.

Grip 21 is typically a flexible fabric grip and is coupled to trailing portion 18 of body 12. Alternatively, it will be appreciated that grip 21 may be made of other flexible or inflexible materials, such rubber or plastic, and may be positioned at other locations on toy apparatus 10. Grip 21 is typically formed of a single length of material 72 folded back on itself and joined to form a first loop 71 encircling a bar formed in trailing portion 18, and a second loop 74 configured to be gripped by a user.

Figure 8:
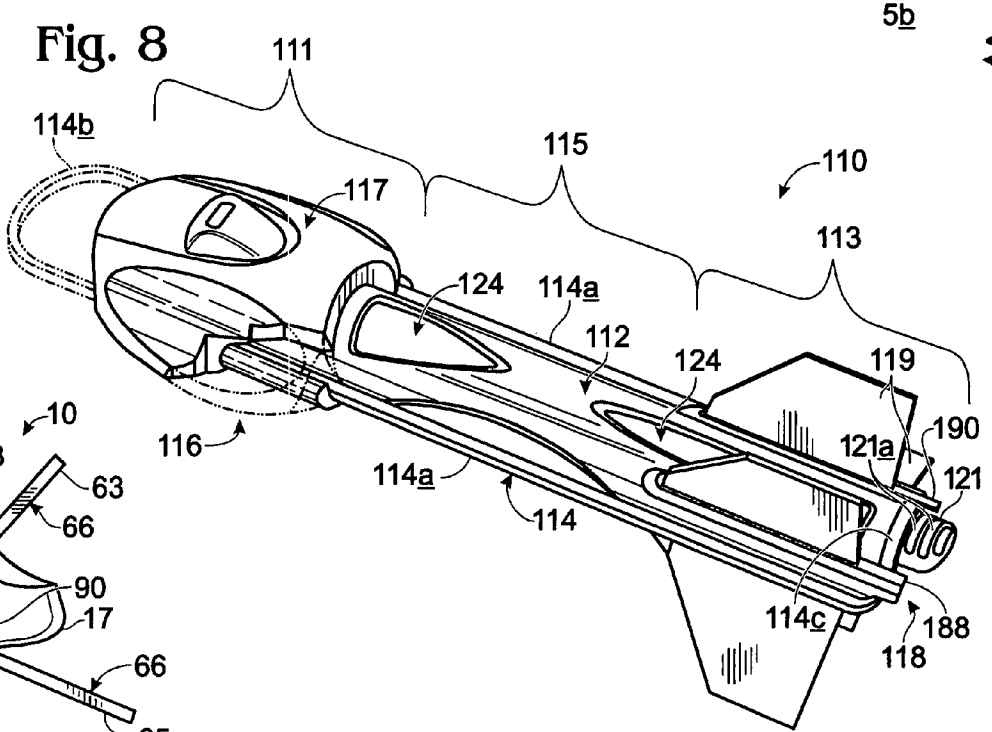
FIG. 8 is a perspective view of a flying toy apparatus according to another embodiment of the present invention.

As discussed above, flying toy apparatus 10 may be launched by pulling on and releasing grip 21. Second loop 74 may facilitate gripping by providing a section of material that may be gripped between, for example, a thumb and a forefinger. The distal end of the grip is typically enlarged. This enlargement may be accomplished, for example, by forming the loop 74 with a segment of fabric, and tucking the ends of the fabric under prior to joining at the distal end, so that there are four layers of fabric joined together to form the enlarged portion, rather than just two layers as in the remaining portions of grip 21. Grip 21 is typically provided on the body in a location adjacent channel 20, such that the user may pull rearward on the grip in a direction substantially in-line with longitudinal axis 20*a*. Other forms of grip may be provided, as shown in FIG. 8, or alternatively, a grip may be omitted and the user may directly grip the trailing portion of body 12, fins 19, etc.

The operation of flying toy apparatus 10 will now be described with reference to FIG. 6. Initially, the user inserts a digit 4 of first hand 5*a* into elongate passage 20 at the position shown at 4*a*, and grasps grip 21. The user stretches the elongate member from the retracted state, to the extended state shown in FIG. 6. The user next aims the flying toy apparatus 10 in the desired direction and releases the grip to launch the flying toy apparatus 10. The potential energy stored in the extended elastic member 14 propels body 12 in the direction of the elongated elastic member.

The flying toy is launched forward and travels along the longitudinal axis 20*a*. As the flying toy apparatus 10 is being launched over the digit 4 of the user, the digit is allowed to pass through channel 120, as shown at positions 4*b* and 4*c*, thereby avoiding a full frontal collision between the digit and the body 12. Typically, the digit passes through the channel without impacting nose member 17 at all. Under certain launch conditions, however, the digit may be arrive at the entrance to the channel slightly off the longitudinal axis 20*a*. Under these conditions, guiding surface 17*a* of the soft and funnel-shaped nose member 17, is configured to guide the digit safely into the channel. In this manner, the apparatus protects the user from painful impacts associated with prior devices.

After launch, the elastic member returns to the retracted, streamlined state. To distribute and absorb the impact of the elastic member after it is released and returns to the retracted position, body 12 is provided with resting flanges 96 along a front surface of the body, as shown in FIGS. 2 and 5. Resting flanges 96 broaden the area of impact between spanning portion 14*b* and leading portion 16, and help to prevent damage to the elastic member.

Upon landing, the impact of nose member 17 with the landing area may press nose member 17 against leading portion 16 of body 12. As shown in FIG. 5, to distribute and absorb forces associated with the impact of nose member 17 with the landing surface, a nose flange 98 may be provided on top surface 36 of arched portion 28. Nose flange 98 may be configured to project upward away from top surface 36 at leading portion 16 of arched portion 28. Like resting flanges 96, nose flange may be configured to broaden the area of impact between nose member 17 and leading portion 16. Additionally, nose flange 98 may be configured to assist in securing weight 41 and nose member 17 in their proper positions. Other flanges, shown at 98*a* and 98*b*, may also be provided for gripping into the nose member from the body and preventing slipping therebetween.

Referring to FIG. 8, a flying toy apparatus according to another embodiment of the present invention is shown generally at 110. Flying toy apparatus 110 is similar to flying toy apparatus 10, except as described differently below. Like numbered parts are numbered similarly. For the sake of brevity, similarities will not be re-described in detail.

Flying toy apparatus 110 typically includes a body 112, elastic member 114, nose member 117, and fins 119. Elastic member 114 is typically a continuous loop elastic member, such as a rubber band. Alternatively, looped elastic members of other materials may be used. Elastic member 114 is configured to loop around both a leading portion 116 and a trailing portion 118 of body 112. Elastic member 114 typically includes a spanning portion 14*b*, and side portions 14*a*, which may be positioned in guides, as described above.

Elastic member 114 further includes a rear bridging portion 14*c*, which is configured to travel under extensions 188, 190, and over grip 121, to thereby travel up and over the channel. In this orientation the elastic member 114 does not interfere with the passage of a digit through the channel. The elastic member is tightly but not fixedly coupled to the body, to allow for stretching of the elastic member though the guides and around extensions 188, 190 and grip 121. While typically the entirety of elastic members 114, 14 are made from elastic material; it will be appreciated that the elastic member may include both elastic portions and inelastic portions.

Flying toy apparatus 112 also typically includes a grip 121. Grip 121 is typically a plastic tab extending from the tailing portion 118 of the body 112. The grip includes several regions of enlargement, namely, ribs 121*a*, which facilitate a sure grip by the user. While typically positioned adjacent the tailing portion 116 above the channel in body 112, it will be appreciated that grip 121 alternatively may be positioned at other locations on body 112.

Flying toy apparatus 110 has a center of gravity and a center of effort. Flying toy apparatus 110 may be configured with the center of gravity disposed substantially forward of the center of effort, at least prior to launch of the flying toy apparatus 110. Flying toy apparatus 110 may be configured to have a leading segment 111, a trailing segment 113, and an intermediate segment 115 therebetween. According to one embodiment of the present invention, the mass of the leading segment 111 may be configured to be substantially equal to the mass of trailing segment 113 and intermediate segment 115 combined. This weight distribution may also be applied in apparatus 10. Of course, a wide variety of other weight distributions are also possible.

Furthermore, in addition to the rocket-shaped embodiments shown in FIGS. 1–8, flying toy apparatus 110 may be configured to resemble other spacecraft and flying machines, such as airplanes, gliders, helicopters, missiles, space shuttles, satellites, flying saucers, etc., and may include wings for a more glider-like flight path. Alternatively, flying toy apparatus 110 may be configured to resemble fictional characters, or flying creatures such as birds, bats, and flying squirrels. Further, while the nose member, body, and fins of the present invention are shown as discrete parts that are assembled together to form the flying toy apparatus, it will be appreciated that these parts may be formed in a unitary structure, for example, by molding a common material for all parts, or co-molding of different materials for each part. The present invention has industrial applicability to the toy industry. The above-described embodiments provide a flying toy apparatus that reduces undesirable launch impacts associated with prior devices, and provides the convenience of an integrated launch system. Because no separate launch system is required, the toy apparatus of the present invention may be used in games of catch between two or more persons, without each person having to carry a separate launcher. Also, there are no separate pieces that might be lost and thus cause the flying toy apparatus to be inoperable.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and sub-combinations of the various elements, features, functions, and/or properties disclosed herein. The following claims define certain combinations and sub-combinations of features, functions, elements, and/or properties that are regarded as novel and non-obvious. Other combinations and sub-combinations may be claimed through amendment of the present claims or presentation of new claims in this or a related application. Such claims, whether they are broader, narrower, equal, or different in scope to any earlier claims, also are regarded as included within the subject matter of the invention.

I claim:

1. A flying toy apparatus comprising:

a body having an elongate channel formed therein, the channel extending in a longitudinal direction along the body; and an elastic launch member coupled to the body and configured to be stretched forward in the longitudinal direction by a digit of a user;

wherein the channel is substantially barrier free along an entire length of the channel to accommodate passage of the digit therein during launch of the body over the digit.

2. The apparatus of claim 1, wherein the channel is downwardly facing.

3. The apparatus of claim 2, wherein the channel is substantially U-shaped.

4. The apparatus of claim 2, wherein the body includes a curved wall defining the downwardly facing channel.

5. The apparatus of claim 4, wherein the curved wall includes an opening formed therein.

6. The apparatus of claim 5, wherein the opening is formed on a side region of the curved wall.

7. The apparatus of claim 5, wherein the opening is formed in a top region of the curved wall.

8. The apparatus of claim 2, wherein the channel extends along substantially the entire length of a lower surface of the body.

9. The apparatus of claim 2, further comprising a nose member coupled to the body.

10. The apparatus of claim 9, wherein the nose member is at least partially constructed of a resilient material.

11. The apparatus of claim 10, wherein the resilient material is foam.

12. The apparatus of claim 9, wherein nose member includes a whistle.

13. The apparatus of claim 9, wherein the nose member is positioned adjacent a front opening of the channel of the body.

14. The apparatus of claim 13, wherein the nose member includes a guide surface extending forward of the front opening of the channel, the guide surface being configured to guide the digit into the channel as the digit approaches the body during launch.

15. The apparatus of claim 14, wherein the guide surface is generally funnel-shaped, having a forward opening that is wider than the forward opening of the channel.

16. The apparatus of claim 2, wherein the elastic launch member is configured to transition between a stretched state and a retracted state, to thereby impart launch energy to the apparatus.

17. The apparatus of claim 16, wherein the elastic launch member includes a spanning portion that spans the front opening of the channel, as viewed from a front of the body, when the elastic launch member is in the retracted state.

18. The apparatus of claim 17, wherein the elastic launch member includes a pair of side portions, each of the side portions being positioned on an opposite side of the channel.

19. The apparatus of claim 18, wherein the body further includes a pair of guides, each of the guides being positioned on an opposite side of the channel and configured to house a corresponding side portion of the elastic launch member.

20. The apparatus of claim 19, wherein the channel faces downward, and wherein each of the guides includes an upwardly facing notch that is formed adjacent a respective lateral edge of the leading portion of the body, each notch being configured to house a respective side portion of the elastic member.

21. The apparatus of claim 18, wherein the nose member includes a guide surface that is generally funnel-shaped, the funnel-shaped guide surface having a pair of holes formed therein, each hole being formed on an opposite side of the channel, the respective side portions of the elastic member passing through each of the holes in the guide surface.

22. The apparatus of claim 18, wherein the side portions include respective end portions that are fixedly mounted to the body.

23. The apparatus of claim 22, wherein the side portions are fixedly mounted to the body via respective anchors located adjacent a trailing portion of the body.

24. The apparatus of claim 18, wherein the elastic launch member is formed in a loop.

25. The apparatus of claim 24, wherein the elastic launch member further includes a bridging portion that is coupled to the body so as to travel up and over the channel, adjacent a trailing portion of the body.

26. The apparatus of claim 25, wherein the body includes a pair of extensions adjacent the trailing end of the body, the extensions being configured to guide opposite ends of the bridging portion of the elastic member up and over the channel.

27. The apparatus of claim 1, wherein the body includes one or more fins.

28. The apparatus of claim 27, wherein the one or more fins are positioned adjacent a rear end of the body.

29. The apparatus of claim 27, wherein each of the one or more fins is configured to be shape-adjustable by a user, to thereby affect the aerodynamic characteristics of the apparatus.

30. The apparatus of claim 27, wherein the fins are mounted in respective slots on the body.

31. The apparatus of claim 27, wherein the fins are provided in pairs, each pair being formed on a unitary structural element that extends into a respective first slot in the body, and out of a respective second slot in the body, to thereby secure the pair of fins to the body.

32. The apparatus of claim 1, wherein the body includes a grip.

33. The apparatus of claim 32, wherein the grip is mounted adjacent a trailing portion of the body.

34. The apparatus of claim 33, wherein the grip includes fabric.

35. The apparatus of claim 33, wherein the grip includes a plastic tab extending rearward from the trailing portion of the body.

36. The apparatus of claim 32, wherein the grip includes an enlarged region to facilitate grasping by a user.

37. A flying toy apparatus comprising:

a body having an elongate channel formed therein, the channel extending in a longitudinal direction along the body;

an elastic launch member coupled to the body and configured to be stretched forward in the longitudinal direction by a digit of a user; and a resilient nose member coupled to the body adjacent a leading portion of the body; and a grip coupled adjacent a trailing end of the body;

wherein the channel is substantially barrier free along an entire length of the channel to accommodate passage of the digit therein during launch of the body over the digit.

38. A flying toy apparatus comprising:

a body having an elongate channel formed therein, the channel extending in a longitudinal direction along the body;

an elastic launch member coupled to the body and configured to be stretched forward in the longitudinal direction by a digit of a user; and a resilient nose member coupled to the body adjacent a leading portion of the body, the nose member including a funnel-shaped guide surface tapering inward to the channel;

wherein the channel is substantially barrier free along an entire length of the channel to accommodate passage of the digit therein during launch of the body over the digit.

39. A flying toy apparatus comprising:

a body having an elongate U-shaped channel formed therein, the channel extending in a longitudinal direction along the body; and an elastic launch member fixedly mounted to the body adjacent a trailing portion of the body and configured to be stretched forward in the longitudinal direction by a digit of a user;

wherein the channel is substantially barrier free along an entire length of the channel to accommodate passage of the digit therein during launch of the body over the digit;

wherein the elastic launch member remains mounted to the body after launch.

40. The apparatus of claim 39, wherein the body includes guides coupled to the body, the guides being configured to guide respective portions of the elastic launch member.

41. The apparatus of claim 39, further comprising an impact absorbing nose member coupled to a leading portion of the body.

42. A flying toy apparatus comprising:

an elongate body having a trailing portion, a pair of anchors positioned adjacent the trailing portion, and a pair of guides positioned forward of the anchors;

an elastic launch member having a pair of ends, each end being coupled to a respective anchor, the elastic launch member further having a pair of side portions, each side portion passing through a respective guide, the elastic launch member being configured to be stretched forward in a longitudinal direction by a digit of a user, such that the side portions of the elastic member slide within the guides; and a grip coupled adjacent the trailing portion of the body;

wherein the body is configured to accommodate passage of the digit after release of the grip.

43. A flying toy apparatus comprising:

a body having an elongate channel formed therein, the channel extending in a longitudinal direction along the body, the body including a resting flange; and an elastic launch member coupled to the body and configured to be stretched forward in a longitudinal direction by a digit of a user, from a retracted configuration in which the elastic launch member is at rest against the resting flange, to an extended configuration in which a portion of the elastic member is stretched forward of the resting flange;

wherein the channel is configured to accommodate passage of the digit therein during launch of the body over the digit.

* * * * *